US008348724B2

(12) United States Patent
Doura et al.

(10) Patent No.: US 8,348,724 B2
(45) Date of Patent: Jan. 8, 2013

(54) POLISHING PAD MANUFACTURING METHOD

(75) Inventors: Masato Doura, Osaka (JP); Junji Hirose, Osaka (JP); Kenji Nakamura, Osaka (JP); Takeshi Fukuda, Osaka (JP); Akinori Sato, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 581 days.

(21) Appl. No.: 12/600,201

(22) PCT Filed: May 9, 2008

(86) PCT No.: PCT/JP2008/058619

§ 371 (c)(1),
(2), (4) Date: Nov. 13, 2009

(87) PCT Pub. No.: WO2008/143029

PCT Pub. Date: Nov. 27, 2008

(65) Prior Publication Data

US 2010/0221984 A1 Sep. 2, 2010

(30) Foreign Application Priority Data

May 16, 2007 (JP) ..... 2007-130535

(51) Int. Cl.
*B24B 1/00* (2006.01)

(52) U.S. Cl. ..... 451/59; 51/297; 451/63; 451/527

(58) Field of Classification Search ..... 51/293, 51/297, 298; 451/6, 36, 41, 59, 63
See application file for complete search history.

(56) References Cited

U.S. PATENT DOCUMENTS

| | | | |
|---|---|---|---|
| 5,605,760 | A | 2/1997 | Roberts |
| 5,893,796 | A | 4/1999 | Birang et al. |
| 5,964,643 | A | 10/1999 | Birang et al. |
| 6,045,439 | A | 4/2000 | Birang et al. |
| 6,171,181 | B1 | 1/2001 | Roberts et al. |
| 6,280,290 | B1 | 8/2001 | Birang et al. |
| 6,358,130 | B1 | 3/2002 | Freeman et al. |
| 6,387,312 | B1 | 5/2002 | Roberts et al. |
| 6,454,630 | B1 | 9/2002 | Tolles |

(Continued)

FOREIGN PATENT DOCUMENTS

CN 1506211 6/2004

(Continued)

OTHER PUBLICATIONS

Chinese Notification of the Second Office Action mailed Jul. 22, 2011, directed to Chinese Application No. 200880012254.8; 10 pages.

(Continued)

*Primary Examiner* — Timothy V Eley
(74) *Attorney, Agent, or Firm* — Morrison & Foerster LLP

(57) ABSTRACT

A method for manufacturing a polishing pad prevents slurry leaks and provides a pad that can be used to provide high optical detection accuracy. The method for manufacturing a polishing pad includes forming a groove for injecting a light-transmitting region forming material on the back surface of a polishing layer; injecting the light-transmitting region forming material into the groove and curing the material to form a light-transmitting region; and buffing the front surface of the polishing layer to expose the light-transmitting region on the front surface.

2 Claims, 2 Drawing Sheets

U.S. PATENT DOCUMENTS

| | | | | |
|---|---|---|---|---|
| 6,524,164 | B1 | 2/2003 | Tolles | |
| 6,537,133 | B1 | 3/2003 | Birang et al. | |
| 6,599,765 | B1 * | 7/2003 | Boyd et al. | 438/16 |
| 6,676,717 | B1 | 1/2004 | Birang et al. | |
| 6,719,818 | B1 | 4/2004 | Birang et al. | |
| 6,876,454 | B1 | 4/2005 | Birang et al. | |
| 7,112,119 | B1 | 9/2006 | Swedek et al. | |
| 7,163,437 | B1 | 1/2007 | Swedek et al. | |
| 7,871,309 | B2 * | 1/2011 | Ogawa et al. | 451/41 |
| 2001/0036805 | A1 | 11/2001 | Birang et al. | |
| 2003/0109197 | A1 | 6/2003 | Tolles | |
| 2003/0129931 | A1 | 7/2003 | Konno et al. | |
| 2003/0171070 | A1 | 9/2003 | Tolles | |
| 2003/0190867 | A1 | 10/2003 | Birang et al. | |
| 2004/0014395 | A1 | 1/2004 | Birang et al. | |
| 2004/0106357 | A1 | 6/2004 | Birang et al. | |
| 2005/0009448 | A1 | 1/2005 | Misra et al. | |
| 2005/0113008 | A1 | 5/2005 | Roberts | |
| 2005/0170751 | A1 | 8/2005 | Birang et al. | |
| 2005/0245171 | A1 | 11/2005 | Hosaka et al. | |
| 2006/0014476 | A1 | 1/2006 | Birang et al. | |
| 2006/0019587 | A1 | 1/2006 | Deopura et al. | |
| 2006/0037699 | A1 | 2/2006 | Nakamori et al. | |
| 2006/0154568 | A1 | 7/2006 | Tolles | |
| 2006/0189269 | A1 | 8/2006 | Roy et al. | |
| 2006/0276109 | A1 | 12/2006 | Roy et al. | |
| 2007/0015441 | A1 | 1/2007 | Birang et al. | |
| 2007/0021037 | A1 | 1/2007 | Birang et al. | |
| 2007/0049167 | A1 | 3/2007 | Swedek et al. | |
| 2007/0190905 | A1 | 8/2007 | Shimomura et al. | |
| 2008/0090498 | A1 | 4/2008 | Misra et al. | |
| 2008/0207100 | A1 | 8/2008 | Roy et al. | |
| 2008/0211141 | A1 | 9/2008 | Deopura et al. | |
| 2008/0227367 | A1 | 9/2008 | Birang et al. | |
| 2009/0053976 | A1 | 2/2009 | Roy et al. | |
| 2009/0253353 | A1 | 10/2009 | Ogawa et al. | |
| 2010/0273398 | A1 | 10/2010 | Misra et al. | |

FOREIGN PATENT DOCUMENTS

| | | |
|---|---|---|
| CN | 1926666 | 3/2007 |
| CN | 1939667 | 4/2007 |
| JP | 2-145326 | 6/1990 |
| JP | 6-134946 | 5/1994 |
| JP | 9-7985 | 1/1997 |
| JP | 10-83977 | 3/1998 |
| JP | 11-512977 | 11/1999 |
| JP | 2001-291686 | 10/2001 |
| JP | 2003-507199 | 2/2003 |
| JP | 2003-510826 | 3/2003 |
| JP | 2003-133270 | 5/2003 |
| JP | 2005-175464 | 6/2005 |
| JP | 2005-210143 | 8/2005 |
| JP | 2005-340795 | 12/2005 |
| JP | 2006-159386 | 6/2006 |
| WO | WO-2006/089293 | 8/2006 |

OTHER PUBLICATIONS

Chinese Office Action mailed Aug. 4, 2010, directed to corresponding Chinese Application No. 200880012254.8; 8 pages.

* cited by examiner

POLISHING PAD MANUFACTURING METHOD

REFERENCE TO RELATED APPLICATIONS

This application is a national stage application under 35 USC 371 of International Application No. PCT/JP2008/058619, filed May 9, 2008, which claims the priority of Japanese Patent Application No. 2007-130535, filed May 16, 2007, the contents of both of which prior applications are incorporated herein by reference.

FIELD OF THE INVENTION

The present invention relates to a method for production of a polishing pad by which the planarizing processing of optical materials such as lenses, reflecting mirrors and the like, silicon wafers, glass substrates for hard disks, aluminum substrates, and materials requiring a high degree of surface planarity such as those in general metal polishing processing can be carried out stably with high polishing efficiency. The polishing pad obtained by the manufacturing method of the present invention is used particularly preferably in a process of planarizing a silicone wafer, and a device having an oxide layer, a metal layer or the like formed on a silicon wafer, before lamination and formation of the oxide layer, the metal layer or the like.

BACKGROUND OF THE INVENTION

Production of a semiconductor device involves a step of forming an electroconductive film on the surface of a wafer to form a wiring layer by photolithography, etching etc., a step of forming an interlaminar insulating film on the wiring layer, etc., and an uneven surface made of an electroconductive material such as metal and an insulating material is generated on the surface of a wafer by these steps. In recent years, processing for fine wiring and multilayer wiring is advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique wherein while the surface of a wafer to be polished is pressed against a polishing surface of a polishing pad, the surface of the wafer is polished with an abrasive in the form of slurry having abrasive grains dispersed therein (hereinafter, referred to as slurry). As shown in FIG. 1, a polishing apparatus used generally in CMP is provided for example with a polishing platen 2 for supporting a polishing pad 1, a supporting stand (polishing head) 5 for supporting a polished material (wafer) 4, a backing material for uniformly pressurizing a wafer, and a mechanism of feeding an abrasive. The polishing pad 1 is fitted with the polishing platen 2 for example via a double-sided tape. The polishing platen 2 and the supporting stand 5 are provided with rotating shafts 6 and 7 respectively and are arranged such that the polishing pad 1 and the polished material 4, both of which are supported by them, are opposed to each other. The supporting stand 5 is provided with a pressurizing mechanism for pushing the polished material 4 against the polishing pad 1.

When CMP is conducted, there is a problem of judging the planarity of wafer surface. That is, the point in time when desired surface properties or planar state are reached should be detected. With respect to the thickness of an oxide film, polishing speed etc., the polishing treatment of a test wafer has been conducted by periodically treating the wafer, and after the results are confirmed, a wafer serving as a product is subjected to polishing treatment.

In this method, however, the treatment time of a test wafer and the cost for the treatment are wasteful, and a test wafer and a product wafer not subjected to processing are different in polishing results due to a loading effect unique to CMP, and accurate prediction of processing results is difficult without actual processing of the product wafer.

Accordingly, there is need in recent years for a method capable of in situ detection of the point in time when desired surface properties and thickness are attained at the time of CMP processing, in order to solve the problem described above. While various methods are used for such detection, an optical detection method using a film thickness monitoring mechanism with a laser beam, which is incorporated in a rotary platen, is becoming the mainstream in view of measurement accuracy or spatial resolution in non-contact measurement.

The optical detection means is specifically a method of detecting the endpoint of polishing by irradiating a wafer via a polishing pad through a window (light-transmitting region) with a light beam, and monitoring an interference signal generated by reflection of the light beam.

In such method, the endpoint is determined by knowing an approximate depth of surface unevenness by monitoring a change in the thickness of a surface layer of a wafer. When such change in thickness becomes equal to the thickness of unevenness, the CMP process is finished. As a method of detecting the endpoint of polishing by such optical means and a polishing pad used in the method, various methods and polishing pads have been proposed.

A polishing pad having, as least a part thereof, a solid and uniform transparent polymer sheet passing a light of wavelengths of 190 to 3500 nm therethrough is disclosed (Patent Literature 1). Further, a polishing pad having a stepped transparent plug inserted into it is disclosed (Patent Literature 2). A polishing pad having a transparent plug on the same surface as a polishing surface is disclosed (Patent Literature 3). There is also disclosed a polishing pad having a window produced from an aliphatic polyisocyanate, a hydroxyl-containing material and a curing agent (Patent Literature 4).

Besides, a proposal is also offered for preventing a slurry from leaking out an interface (joint line) between a polishing region and a light-transmitting region (Patent Literature 5 and 6).

There is also disclosed a method for manufacturing a polishing pad, which includes placing a rod or plug of a first resin in a liquid of a second resin, curing the second resin to prepare a formed product, and slicing the formed product to form a polishing pad having a light-transmitting region and a polishing region integrated together (Patent Literature 7). However, since this manufacturing method includes inserting a transparent plug into an opaque resin remaining in a liquid state and curing the opaque resin, too high pressure or stress may be applied to the transparent plug from the opaque resin in the process of curing the opaque resin, which may cause residual stress deformation or swelling of the transparent plug. The residual stress deformation or swelling degrades the flatness of the transparent plug to make the optical detection accuracy unsatisfactory. In addition, the stress caused by the thermal contraction difference between both materials remains at the bonding interface between both materials during the forming process, so that separation may easily occur at the bonding interface, which may cause slurry leaks.

There is also disclosed an integrally-formed polishing pad having a transparent polymer material region and an opaque polymer material region placed adjacent thereto (Patent Literature 8). In the production of this polishing pad, a fluid polymer material is cured at different cure rates in the respective regions of a molding cavity so that a transparent region and an opaque region can be integrally formed. In this production method, however, the temperature control to change the cure rate is difficult so that the light transmittance of the transparent region may vary or it may be impossible to obtain satisfactory light transmittance.

Patent Literature 1: JP-A National Publication (Laid-Open) No. 11-512977

Patent Literature 2: JP-A 9-7985

Patent Literature 3: JP-A 10-83977

Patent Literature 4: JP-A 2005-175464

Patent Literature 5: JP-A 2001-291686

Patent Literature 6: JP-A National Publication (Laid-Open) No. 2003-510826

Patent Literature 7: JP-A 2005-210143

Patent Literature 8: JP-A National Publication (Laid-Open) No. 2003-507199

SUMMARY OF THE INVENTION

As a result of investigations to solve the above problems, the inventors have made the invention based on the finding that the object can be achieved using the polishing pad manufacturing method described below.

The invention is directed to a method for manufacturing a polishing pad, comprising the steps of: forming a groove for injecting a light-transmitting region forming material, on the back surface of a polishing layer; injecting the light-transmitting region forming material into the groove and curing the material to form a light-transmitting region; and buffing the front surface of the polishing layer to expose the light-transmitting region on the front surface.

According to the manufacturing method, the thickness of the light-transmitting region can be easily controlled. In addition, a thin light-transmitting region can be formed so that the light transmittance can be improved. The polishing region and the light-transmitting region can be integrally formed with no space between them, which prevents slurry leaks during polishing.

After the buffing, the thickness of the light-transmitting region is preferably 20 to 90% of the thickness of the polishing layer. If it is less than 20%, the light-transmitting region may be worn out or made too thin when the polishing pad is used for long hours, so that the optical detection may become impossible or the optical detection accuracy may tend to be low due to slurry leaks. If it is more than 90%, the light-transmitting region may be too thick to be insufficiently effective in improving the light transmittance.

An another invention is directed to a polishing pad manufactured by the above method and a method for manufacturing a semiconductor device including the step of polishing the surface of a semiconductor wafer with the polishing pad.

DETAILED DESCRIPTION OF THE INVENTION

Figure 1:
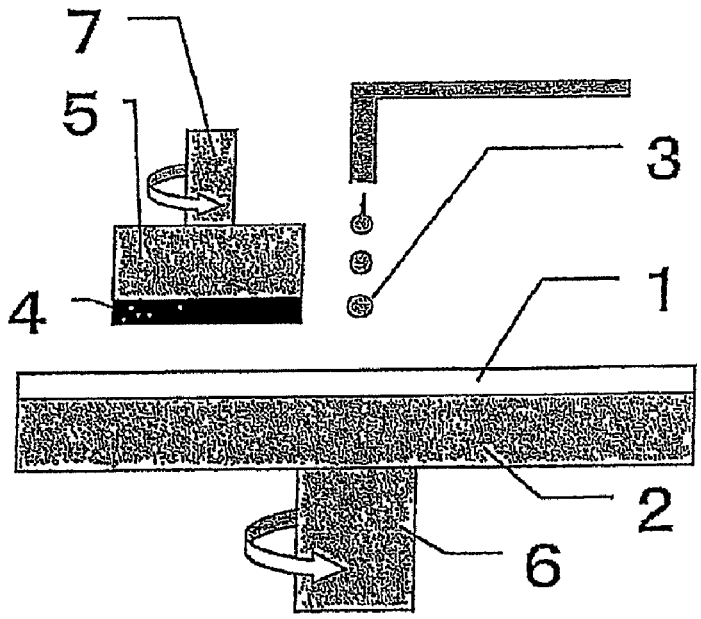
FIG. 1 is a schematic configuration diagram showing an example of a polishing apparatus for use in CMP polishing.

The method of the invention for manufacturing a polishing pad includes the steps of forming a groove for injecting a light-transmitting region forming material, on the back surface of a polishing layer, injecting the light-transmitting region forming material into the groove and curing the material to form a light-transmitting region, and buffing the front surface of the polishing layer to expose the light-transmitting region on the front surface. The polishing pad of the invention may be the polishing layer alone or a laminate of the polishing layer and any other layer (such as a cushion layer).

The polishing layer may be made of a foam having fine cells. Examples of raw materials for such a foam include polyurethane resin, polyester resin, polyamide resin, acrylic resin, polycarbonate resin, halogen resin (such as polyvinyl chloride, polytetrafluoroethylene and polyvinylidene fluoride), polystyrene, olefin resin (such as polyethylene and polypropylene), epoxy resin, and photosensitive resin. One of these resins may be used alone, or a mixture of two or more of these resins may be used. Polyurethane resin is particularly preferred as polishing layer-forming materials, because polyurethane resin is excellent in abrasion resistance and polymers with desired physical properties can be easily obtained by varying the raw material composition. Polyurethane resin is described below as typical foams.

The polyurethane resin comprises an isocyanate component, a polyol component (high-molecular-weight polyol, low-molecular-weight polyol etc.) and a chain extender.

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and cycloaliphatic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof.

As the high-molecular-weight polyol, those usually used in the art of polyurethane can be exemplified. Examples thereof include polyether polyols represented by polytetramethylene ether glycol and polyethylene glycol; polyester polyols represented by polybutylene adipate; polyester polycarbonate polyols exemplified by reaction products of polyester glycol such as polycaprolactone polyol or polycaprolactone and alkylene carbonate; polyester polycarbonate polyols obtained by reacting ethylene carbonate with polyvalent alcohol and the reacting the resultant reaction mixture with an organic dicarboxylic acid; and polycarbonate polyols obtained by ester exchange reaction between polyhydroxyl compound and aryl carbonate. These may be used singly or in combination of two or more kinds.

Besides the above high-molecular-weight polyol described in the above as a polyol component, it is preferred to concomitantly use a low-molecular-weight polyol such as ethyleneglycol, 1,2-propylene glycol, 1,3-propylene glycol, 1,4-butanediol, 1,6-hexanediol, neopentylglyol, 1,4-cyclohexanedimethanol, 3-methyl-1,5-pentanediol, diethyleneglycol, triethyleneglycol, and 1,4-bis (2-hydroxyethoxy)benzene. Low-molecular-weight polyamine such as ethylenediamine, tolylenediamine, diphenylmethanediamine, and diethylenetriamine may be used.

In the case where a polyurethane foam is produced by means of a prepolymer method, a chain extender is used in curing of a prepolymer. A chain extender is an organic compound having at least two active hydrogen groups and examples of the active hydrogen group include: a hydroxyl group, a primary or secondary amino group, a thiol group (SH) and the like. Concrete examples of the chain extender include: polyamines such as 4,4'-methylenebis(o-chloroaniline) (MOCA), 2,6-dichloro-p-phenylenediamine, 4,4'-methylenebis(2,3-dichloroaniline), 3,5-bis (methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethylene oxide-di-p-aminobenzoate, 4,4'-diamino-3,3',5,5'-tetraethyldiphenylmethane, 4,4'-diamino-3,3'-diisopropyl-5,5'-dimethyldiphenylmethane, 4,4'-diamino-3,3',5,5'-tetraisopropyldiphenylmethane, 1,2-bis (2-aminophenylthio) ethane, 4,4'-diamino-3,3'-diethyl-5,5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; low-molecular-weight polyol; and a low-molecular-weight polyamine. The chain extenders described above may be used either alone or in mixture of two kinds or more.

A ratio between an isocyanate component, a polyol component and a chain extender can be altered in various ways according to molecular weights thereof, desired physical properties of polyurethane foam and the like. In order to obtain polyurethane foam with desired polishing characteristics, a ratio of the number of isocyanate groups in an isocyanate component relative to a total number of active hydrogen groups (hydroxyl groups+amino groups) in a polyol component and a chain extender is preferably in the range of from 0.80 to 1.20 and more preferably in the range of from 0.99 to 1.15. When the number of isocyanate groups is outside the aforementioned range, there is a tendency that curing deficiency is caused, required specific gravity and hardness are not obtained, and polishing property is deteriorated.

Manufacture of a polyurethane foam is enabled by means of either a prepolymer method or a one shot method, of which preferable is a prepolymer method in which an isocyanate-terminated prepolymer is synthesized from an isocyanate component and a polyol component in advance, with which a chain extender is reacted since physical properties of an obtained polyurethane resin is excellent.

Manufacturing methods of a polyurethane foam include: a method in which hollow beads are added, a mechanically foaming method, a chemically foaming method and the like.

Particularly, a mechanically foaming method using a silicone-based surfactant which is a copolymer of polyalkylsiloxane and polyether is preferable. As such the silicone-based surfactant, B-8443 and B-8465 (manufactured by Goldschmidt Corporation) etc. are exemplified as a suitable compound.

Description will be given of an example of a method of producing a polishing layer comprising a polyurethane foam below. A method of manufacturing such a polishing layer has the following steps:

1) a foaming step of preparing a cell dispersion liquid of an isocyanate-terminated prepolymer (first component), wherein a silicone-based surfactant is added into an isocyanate-terminated prepolymer, which is agitated in the presence of a non-reactive gas to thereby disperse the non-reactive gas into the prepolymer as fine cells and obtain a cell dispersion liquid. In a case where the prepolymer is solid at an ordinary temperature, the prepolymer is preheated to a proper temperature and used in a molten state.
2) a curing agent (chain extender) mixing step, wherein a chain extender (second component) is added into the cell dispersion liquid, which is agitated to thereby obtain a foaming reaction liquid.
3) a casting step, wherein the foaming reaction liquid is cast into a mold.
4) a curing step, wherein the foaming reaction liquid having been cast into the mold is heated and reaction-cured.

The non-reactive gas used for forming fine cells is preferably not combustible, and is specifically nitrogen, oxygen, a carbon dioxide gas, a rare gas such as helium and argon, and a mixed gas thereof, and the air dried to remove water is most preferable in respect of cost.

As a stirrer for dispersing the silicone-based surfactant-containing first component to form fine cells with the non-reactive gas, known stirrers can be used without particular limitation, and examples thereof include a homogenizer, a dissolver, a twin-screw planetary mixer etc. The shape of a stirring blade of the stirrer is not particularly limited either, but a whipper-type stirring blade is preferably used to form fine cells.

In the method of producing the polyurethane foam, heating and post-curing of the foam obtained after casting and reacting the foaming reaction liquid in a mold until the dispersion lost fluidity are effective in improving the physical properties of the foam, and are extremely preferable. The foaming reaction liquid may be cast in a mold and immediately post-cured in a heating oven, and even under such conditions, heat is not immediately conducted to the reactive components, and thus the diameters of cells are not increased. The curing reaction is conducted preferably at normal pressures to stabilize the shape of cells.

Production of the polyurethane foam may be in a batch system where each component is weighed out, introduced into a vessel and mixed or in a continuous production system where each component and a non-reactive gas are continuously supplied to, and stirred in, a stirring apparatus and the resulting foaming reaction liquid is transferred to produce molded articles.

A manufacturing method of a polishing pad may be performed in ways: in one of which a prepolymer which is a raw material from which a polyurethane foam is made is put into a reactor, thereafter a chain extender is mixed into the prepolymer, the mixture is agitated, thereafter the mixture is cast into a mold with a predetermined size to thereby prepare a block and the block is sliced with a slicer like a planer or a band saw; and in another of which in the step of casting into the mold, a thin sheet may be directly produced. Besides, a still another way may be adopted in which a resin of raw material is melted, the melt is extruded through a T die to thereby mold a polyurethane foam directly in the shape of a sheet.

An average cell diameter of a polyurethane foam is preferably in the range of from 30 to 80 μm and more preferably in the range of from 30 to 60 μm. If an average cell diameter falls outside the range, a tendency arises that a polishing rate is decreased and a planarity of an object to be polished (a wafer) after polishing is reduced.

Preferably, the polyurethane foam has a specific gravity ranging from 0.5 to 1.3. When the specific gravity is less than 0.5, the surface strength of the polishing layer decreases, so that the planarity of the polished substance tends to decrease. When the specific gravity is larger than 1.3, the cell number on the surface of the polishing layer decreases, so that the polishing rate tends to decrease despite excellent planarity.

Preferably, the polyurethane foam has a hardness measured by ASKER D hardness meter, ranging from 45 to 70 degrees.

When the ASKER D hardness is less than 45 degrees, the planarity of the polished substance decreases, while when the hardness is more than 70 degrees, the uniformity of the polished substance tends to decrease despite excellent planarity.

Before the buffing, the thickness of the polishing layer is generally, but not limited to, from about 0.8 to about 4 mm, preferably from 1.5 to 2.5 mm. Examples of methods for preparing the polishing layer with such a thickness include a method including slicing a block of the foam into slices with a specific thickness using a hand saw-type or planer-type slicer, a method including casting a resin into a mold having a cavity with a specific thickness and curing the resin, and a method using a coating technique or a sheet forming technique.

Figure 2:
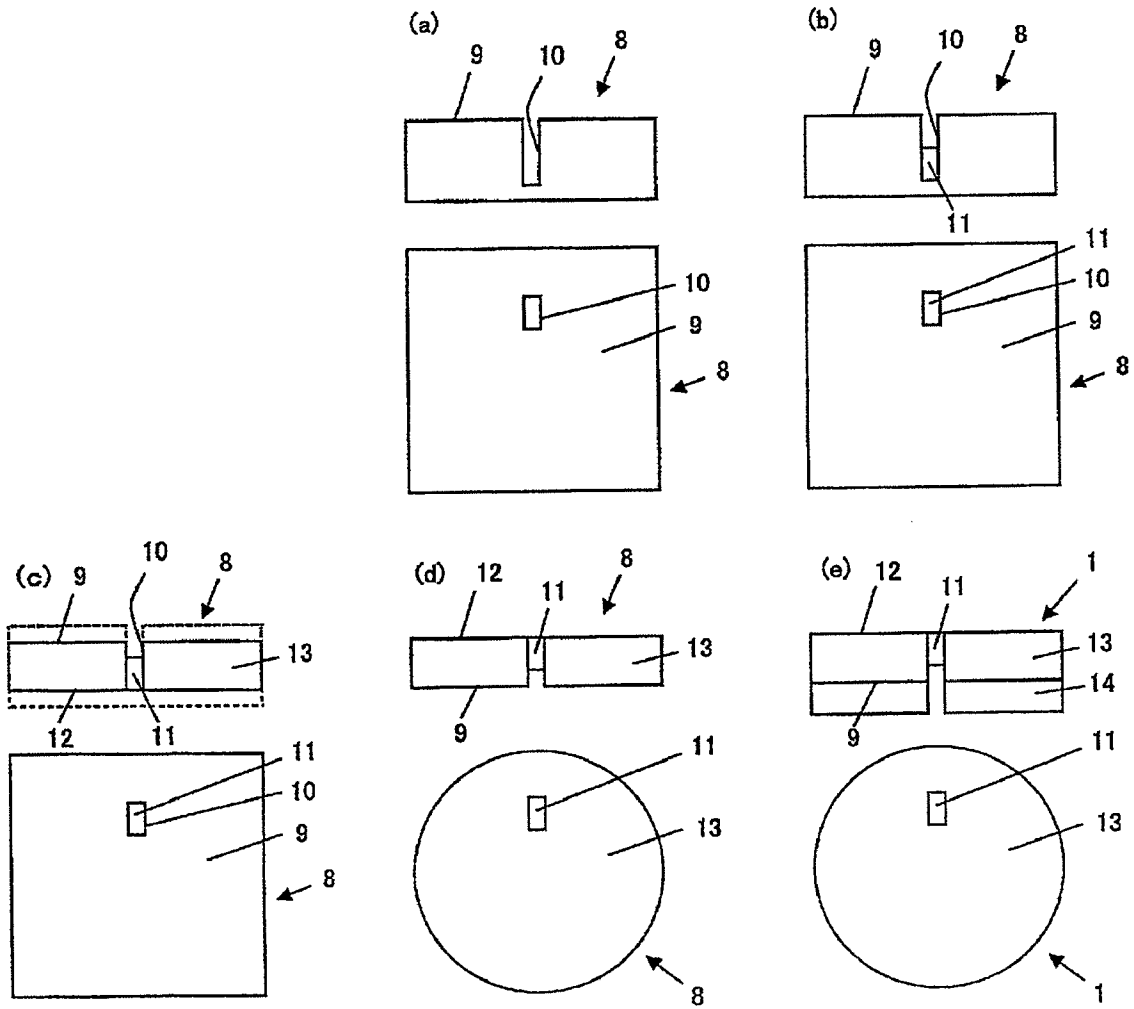
FIG. 2 is a schematic diagram showing an example of a production step of a polishing pad according to the invention.

The method of the invention for manufacturing a polishing pad is described in detail below with reference to FIG. 2. FIG. 2 is a process drawing showing an example of the method of the invention for manufacturing a polishing pad. In each section showing each process, the upper part is a cross-sectional view, and the lower part is a plan view.

The step (a) includes forming a groove 10 for injecting a light-transmitting region forming material, on a back surface 9 of a polishing layer 8. In the step (a), the shape of the polishing layer is typically, but not limited to, a square, a rectangle or a circle. The thickness of the polishing layer 8 is preferably adjusted as needed. When the polishing layer is circular, a single groove is preferably formed between the center and the edge of the polishing layer, while the number and location of the grooves to be formed are not particularly limited. The shape of the groove is typically, but not limited to, a square, a rectangle or a circle. The groove size may be appropriately adjusted depending on the polishing layer size. For example, when the polishing layer has a diameter of 60 cm, the groove may have a size of about 2×4 cm. The groove is required to be not through the polishing layer. In the later step, the front surface of the polishing layer is buffed so that the light-transmitting region is exposed on the front surface. Considering this step, the groove is preferably as deep as possible. Specifically, the depth of the groove is preferably 70% or more, more preferably 80% or more of the thickness of the polishing layer.

Examples of methods for forming the groove 10 include, but not limited to, a method including performing mechanical cutting with a tool with a specific size, a method including casting a resin into a mold having a specific surface shape and curing the resin to form the groove, a method including pressing a resin with a pressing plate having a specific surface shape, a method using photolithography to form the groove, a method using printing to form the groove, and a method using a laser such as a carbon dioxide laser to form the groove.

The step (b) includes injecting the light-transmitting region forming material into the groove 10 and curing the material to form a light-transmitting region 11.

No specific limitation is imposed on a material of which the light-transmitting region is made, but a light transmittance thereof is preferably 40% or more and more preferably 50% or more at a wavelength over all the range of from 300 to 800 nm in wavelength. Examples of such a material include: thermoset resins such as a polyurethane resin, a polyester resin, a phenol resin, a urea resin, a melamine resin, an epoxy resin and an acrylic resin; thermoplastic resins such as a polyurethane resin, a polyester resin, a polyamide resin, a cellulose-based resin, an acrylic resin, a polycarbonate, a halogen containing resin (polyvinyl chloride, polytetrafluoroethylene, polyvinylidene fluoride and the like), a polystyrene and an olefinic resin (polyethylene, polypropylene and the like); light curable resins curable with irradiation of light such as ultraviolet and an electron beam; and photosensitive resins. The resins may be used either alone or in combination of two or more kinds. Note that a thermoset resin is preferably cured at a comparative low temperature. In a case where a light curable resin is employed, a photo-polymerization initiator is preferably employed together. When an aromatic hydrocarbon group-containing resin is used, the light transmittance tends to be low on the short wavelength side. Therefore, such a resin is preferably not used. Of these resins, the thermosetting resin is preferably used, and in particular, a thermosetting polyurethane resin is preferably used.

The amount of the light-transmitting region forming material to be injected is preferably, but not limited to, from 20 to 90%, more preferably from 30 to 60% of the depth of the groove 10.

When a thermosetting polyurethane resin is used as the light-transmitting region forming material, the step may include injecting the resin into the groove, controlling the thickness of the resin to make it uniform, and then heating the resin at about 40 to about 100° C. for about 5 to about 10 minutes to cure. When a thermoplastic resin is used as the light-transmitting region forming material, the step may include injecting a melt of the thermoplastic resin into the groove, controlling the thickness of the resin to make it uniform, and then cooling the resin to cure. When a photocurable resin is used as the light-transmitting region forming material, the resin may be cured by irradiation of light such as ultraviolet light or electron beam. In order to provide high light transmittance, the light-transmitting region is preferably as free as possible of cells.

The step (c) includes buffing a front surface 12 of the polishing layer 8 to expose the light-transmitting region on the front surface. Buffing is preferably performed in a stepwise manner with abrasive materials different in particle size or the like so that the surface of the exposed light-transmitting region will not be scratched.

The front surface 12 is preferably buffed so that variations in thickness can be reduced to 100 μm or less. It is also preferred that both of the front surface 12 and the back surface 9 should be buffed so that variations in thickness can be reduced to 100 μm or less. When the variations in thickness is higher than 100 μm, large undulation is caused to generate portions different in a contacting state with a substance to be polished, thus adversely influencing polishing characteristics. To solve the variations in thickness of the polishing region, the surface of the polishing region is dressed generally in an initial stage of polishing by a dresser having abrasive grains of diamond deposited or fused thereon, but the polishing region outside of the range described above requires a longer dressing time to reduce the efficiency of production.

After the buffing, the thickness of the polishing layer is generally, but not limited to, from about 0.5 to about 3 mm, preferably from 1 to 2.5 mm. After the buffing, the thickness of the light-transmitting region is preferably from 20 to 90%, more preferably from 30 to 60% of the thickness of the polishing layer.

The step (d) includes cutting the polishing layer 8 into the desired shape. The polishing layer is generally cut into a circular shape, while it may be cut into any other shape. The step (d) is an optional step, and the polishing layer may be previously cut into the desired shape, before the step (a). The size of the polishing layer 8 may be appropriately adjusted depending on the polishing apparatus to be used. When the polishing layer is circular, its diameter is generally from about 30 to about 120 cm.

The front surface 12 of the polishing region 13 is preferably provided with a depression and a protrusion structure for holding and renewing a slurry. Though in a case where the polishing region is formed with a foam, many openings are on the front surface thereof which works so as to hold the slurry, a depression and protrusion structure are preferably provided on the front surface thereof in order to achieve more of holdability and renewal of the slurry or in order to prevent induction of dechuck error, breakage of a wafer or decrease in polishing efficiency. The shape of the depression and protrusion structure is not particularly limited insofar as slurry can be retained and renewed, and examples include latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These depression and protrusion structure are generally those having regularity, but the groove pitch, groove width, groove depth etc. can also be changed at each certain region to make retention and renewal of slurry desirable.

The step (e) includes bonding a cushion layer 14 to the polishing layer 8 to form a lamination type polishing pad 1. The step (e) is an optional step, and the cushion layer to form a laminate is not essential for the polishing pad.

The cushion layer 14 compensates for characteristics of the polishing layer 8. The cushion layer is required for satisfying both planarity and uniformity which are in a tradeoff relationship in CMP. Planarity refers to flatness of a pattern region upon polishing a wafer having fine unevenness generated upon pattern formation, and uniformity refers to the uniformity of the whole of a wafer. Planarity is improved by the characteristics of the polishing layer, while uniformity is improved by the characteristics of the cushion layer. The cushion layer used in the polishing pad of the present invention is preferably softer than the polishing region.

The material forming the cushion layer is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

For example, means for bonding the polishing layer and the cushion layer together may be based on a method including stacking the polishing layer and the cushion layer with a double-sided tape interposed therebetween and pressing them. The cushion layer should have a through hole of a size suitable for the light-transmitting region.

The polishing pad of the invention may further include a double-sided tape provided on the polishing layer surface or cushion layer surface to be bonded to a platen.

A semiconductor device is fabricated after operation in a step of polishing a surface of a semiconductor wafer with a polishing pad. The term, a semiconductor wafer, generally means a silicon wafer on which a wiring metal and an oxide layer are stacked. No specific limitation is imposed on a polishing method of a semiconductor wafer or a polishing apparatus, and polishing is performed with a polishing apparatus equipped, as shown in FIG. 1, with a polishing platen 2 supporting a polishing pad 1, a polishing head 5 holding a semiconductor wafer 4, a backing material for applying a uniform pressure against the wafer and a supply mechanism of a polishing agent 3. The polishing pad 1 is mounted on the polishing platen 2 by adhering the pad to the platen with a double sided tape. The polishing platen 2 and the polishing head 5 are disposed so that the polishing pad 1 and the semiconductor wafer 4 supported or held by them oppositely face each other and provided with respective rotary shafts 6 and 7. A pressure mechanism for pressing the semiconductor wafer 4 to the polishing pad 1 is installed on the polishing head 5 side. During polishing, the semiconductor wafer 4 is polished by being pressed against the polishing pad 1 while the polishing platen 2 and the polishing head 5 are rotated and a slurry is fed. No specific limitation is placed on a flow rate of the slurry, a polishing load, a polishing platen rotation number and a wafer rotation number, which are properly adjusted.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Description will be given of the invention with examples, while the invention is not limited to description in the examples.

Measurement of Light Transmittance

The light-transmitting region of the prepared polishing pad was cut into a sample piece 10 mm×50 mm in size. The sample was placed in a glass cell (10 mm in optical wavelength, 10 mm in optical path width, 45 mm in height, manufactured by Sogo Laboratory Glass Works Co., Ltd.) filled with ultrapure water, and the light transmittance of the sample was measured at a wavelength of 300 nm using a spectrophotometer (UV-1600PC, manufactured by Shimadzu Corporation). The measured light transmittance was converted into a value per 1 mm thickness according to the Lambert-Beer law.

Evaluation of Film Thickness Detection

Optical detection of the wafer film thickness was evaluated by the method described below. The wafer used was an 8-inch silicon wafer having a 1 μm-thick thermal oxide film. The light-transmitting region obtained by cutting the prepared polishing pad was placed on the wafer. Film thickness measurement was performed several times at a wavelength region of 300 nm using an interference type film thickness meter (manufactured by Otsuka Electronics Co., Ltd.). The result of the film thickness calculation and the peak and valley of the optical interference pattern were checked, and the film thickness detection through the light-transmitting region was evaluated according to the following criteria.

Very good: The film thickness is measured with very high repeatability.

Good: The film thickness is measured with high repeatability.

Poor: The repeatability is poor, and the detection accuracy is insufficient.

Water Leak Evaluation

The prepared polishing pad was used together with a polishing apparatus SPP600S (manufactured by Okamoto Machine Tool Works, Ltd.) and then subjected to a water leak evaluation. After an 8-inch dummy wafer was continuously polished for 30 minutes, the light-transmitting region on the back surface side of the polishing pad was visually checked for whether or not water leaks occurred. The polishing conditions were as follows: a silica slurry (SS12 manufactured by Cabot Microelectronics) as an alkaline slurry added at a flow rate of 150 ml/minute during polishing; a polishing load of 350 g/cm$^2$; a polishing platen rotation speed of 35 rpm; and a wafer rotation speed of 30 rpm. The wafer was polished, while the surface of the polishing pad was dressed using a

#100 dresser. The dressing conditions were as follows: a dressing load of 80 g/cm$^2$ and a dresser rotation speed of 35 rpm.

Example 1

To a vessel were added 100 parts by weight of an isocyanate-terminated prepolymer (Adiprene L-325 manufactured by Uniroyal Chemical Corporation) having a controlled temperature of 70° C. and 3 parts by weight of a silicone surfactant (SH-192 manufactured by Dow Corning Toray Silicone Co., Ltd.), and mixed. The mixture was adjusted to 80° C., reduced in pressure and degassed. The mixture was then vigorously stirred with a twin screw mixer at a rotation number of 900 rpm for about 4 minutes in such a manner that cells were incorporated into the vessel. To the mixture was added 26.2 parts by weight of 4,4'-methylenebis (o-chloroaniline) (Cuamine MT manufactured by Ihara Chemical Industry Co., Ltd.) which had been previously molten at 120° C. The liquid mixture was stirred for about 70 seconds to give a foaming reaction liquid. The foaming reaction liquid was then poured into a pan-shaped open mold (casting vessel). When the foaming reaction liquid lost its fluidity, it was placed in an oven and subjected to post curing at 80 to 85° C. for 12 hours, so that a polyurethane foam block was obtained.

While heated at 80° C., the polyurethane foam block was sliced using a slicer (VGW-125 manufactured by AMITEC Corporation) so that a 1.8 mm-thick polishing layer (50 μm in average cell size, 0.86 in specific gravity, 52 degrees in hardness) was obtained. A 4 cm long, 2 cm wide, 1.5 mm deep groove was formed on the back surface of the polishing layer by cutting.

A light-transmitting region forming material was prepared by mixing 70 parts by weight of an isocyanate-terminated prepolymer (C-2612 manufactured by Nippon Polyurethane Industry Co., Ltd.) having a controlled temperature of 80° C., 9 parts by weight of trimethylolpropane, and 21 parts by weight of polytetramethylene ether glycol with a number average molecular weight of 650 and degassing the mixture. The light-transmitting region forming material was injected into the groove of the polishing layer and subjected to post curing at 100 to 105° C. for 12 hours to form a light-transmitting region. Both sides of the polishing layer were then buffed using a buffing machine (manufactured by AMITEC Corporation) so that the light-transmitting region was exposed on the front surface. After the buffing, the polishing layer had a thickness of 1.27 mm, and the light-transmitting region had a thickness of 1.10 mm. Using a K (concentric circles) grooving machine (manufactured by Techno Corporation), the polishing layer was then cut into a diameter of 60 cm and shaped to have concentric slurry grooves 0.25 mm in width, 1.50 mm in pitch, and 0.40 mm in depth on the front surface. A double-sided tape (#5782W manufactured by Sekisui Chemical Co., Ltd.) was then bonded to the back surface of the polishing layer using a laminator. A portion located at the light-transmitting region is cut away from the double-sided tape with an NT cutter. A cushion layer made of a corona-treated polyethylene foam (Toraypef manufactured by Toray Industries, Inc., 0.8 mm in thickness) and having a through hole to expose the light-transmitting region was then bonded to the double-sided tape using a laminator, so that a polishing pad was obtained.

Example 2

A polishing pad was prepared using the process of Example 1, except that the thickness of the light-transmitting region was changed from 1.10 mm to 0.75 mm.

Example 3

A polishing pad was prepared using the process of Example 1, except that the thickness of the light-transmitting region was changed from 1.10 mm to 0.40 mm.

TABLE 1

| | Light transmittance (%) at 300 nm | Film thickness detection | Water leak |
|---|---|---|---|
| Example 1 | 72.1 | Very good | Not observed |
| Example 2 | 72.2 | Very good | Not observed |
| Example 3 | 72.5 | Very good | Not observed |

The invention claimed is:

1. A method for manufacturing a polishing pad, comprising the steps of:

forming a groove for injecting a light-transmitting region forming material, on a back surface of a polishing layer;

injecting the light-transmitting region forming material into the groove and curing the material to form a light-transmitting region; and buffing a front surface of the polishing layer to expose the light-transmitting region on the front surface.

2. The method of claim 1, wherein after the buffing, the light-transmitting region has a thickness that is 20 to 90% of the thickness of the polishing layer.

* * * * *